US008239980B2

(12) United States Patent
Ying

(10) Patent No.: US 8,239,980 B2
(45) Date of Patent: Aug. 14, 2012

(54) LIGHT-EMITTING SPA BUBBLE MASSAGER

(76) Inventor: Tsai Ying, Zhonghe (TW)

( * ) Notice: Subject to any disclaimer, the term of this patent is extended or adjusted under 35 U.S.C. 154(b) by 163 days.

(21) Appl. No.: 12/877,260

(22) Filed: Sep. 8, 2010

(65) Prior Publication Data

US 2012/0054956 A1 Mar. 8, 2012

(51) Int. Cl.
*A47K 3/00* (2006.01)

(52) U.S. Cl. ..... 4/559; 4/541.1; 4/541.5

(58) Field of Classification Search ..... 4/559, 567–569, 4/541.1, 541.5
See application file for complete search history.

(56) References Cited

U.S. PATENT DOCUMENTS 4,512,934 A * 4/1985 Bucher ..... 4/541.1
6,708,961 B2 * 3/2004 Ferber et al. ..... 4/541.5
6,752,773 B2 * 6/2004 Leung et al. ..... 4/541.5

* cited by examiner

*Primary Examiner* — Tuan N Nguyen
(74) *Attorney, Agent, or Firm* — Ming Chow; Sinorica, LLC

(57) ABSTRACT

A light-emitting spa bubble massager includes an air provider, an air-driven light source connected to the air provider by a connection tube and having mounted therein an electrical generator that is driven to generate electricity when the air provider provides a flow of air through the connection tube into the air-driven light source and a light-emitting module electrically connected to the electrical generator and operable to emit light, and a bubble bath mat for putting in water in a water container for output of the flow of air passing through the air-driven light source to produce bubbles in the water in the water container.

10 Claims, 9 Drawing Sheets

LIGHT-EMITTING SPA BUBBLE MASSAGER

BACKGROUND OF THE INVENTION

1. Field of the Invention

The present invention relates to spa bubble massager and more particularly, to a light-emitting spa bubble massager for use in a bathtub.

2. Description of the Related Art

Many different measures may be adopted to help release stress and relax the muscles. For example, people may install a massage bathtub in the house for massaging the body to combat fatigue and to lessen depression when bathing. However, a massage bathtub is expensive. When using a massage bathtub to replace an ordinary bathtub in a house, the installation requires much time and labor and the related installation cost is high.

In view of the aforesaid problem, bubble massagers are created. These commercial bubble massagers can be directly put in water in a bathtub to generate air bubbles upon connection to a power source. For the advantages of low cost and ease of use, these bubble massagers are widely accepted by consumers. However, these bubble massagers must use an external power source or a battery pack to provide the necessary working voltage. In proper use of these bubble massagers may cause an electric shock. Further, these bubble massagers are used to produce bubbles in water for massaging the body of a person. They do not provide any lighting effect to create a warm and comfortable atmosphere in helping the user smooth the spirit.

SUMMARY OF THE INVENTION

The present invention has been accomplished under the circumstances in view. It is one object of the present invention to provide a light-emitting spa bubble massager, which utilizes the dynamic energy of the supplied flow of air to generate electricity for driving a light-emitting module to emit light during generation of air bubbles in the bathtub, assuring a high level of safety.

It is another object of the present invention to provide a light-emitting spa bubble massager, which emits different colors of light when generating water bubbles to massage the body of a person, creating a warm and pleasant environment.

To achieve these and other objects of the present invention, a light-emitting spa bubble massager comprises an air provider, a connection tube, an air-driven light source and a bubble bath mat. The air provider is adapted for outputting a flow of air. The connection tube is connected with its one end to the air provider. The air-driven light source comprises a housing, which has an air inlet connected to the opposite end of the connection tube for guiding in the flow of air provided by the air provider, an air outlet and an air passage in communication between the air inlet and the air outlet, a lampshade mounted in one side of the housing, an electrical generator installed in the air passage and operable by the flow of air passing through the air passage to generate electricity, and a light-emitting module mounted in the lampshade and electrically connected to the electrical generator and operable to emit light by the electricity generated by the electrical generator. The bubble bath mat is for putting in water in a water container, for example, bathtub, comprising an air inlet connected to the air outlet of the housing of the air-driven light source for guiding in the flow of air provided by the air provider and a plurality of jet nozzles for output of the inputted flow of air into the water in the water container to produce bubbles.

Preferably, the air provider is an air blower.

Preferably, the light-emitting module comprises a plurality of different colors of light emitting diodes controllable to emit different colors of light subject to a predetermined sequence and duration.

Preferably, the bubble bath mat comprises an air inlet connected to the air outlet of the housing of the air-driven light source for guiding in the flow of air, and a plurality of jet nozzles for output of the inputted flow of air to produce air bubbles in the water in the bathtub in which the bubble bath mat is set.

Further, the electrical generator can be a magnet type electrical generator.

Alternatively, the electrical generator can be a rotor coil type electrical generator.

DETAILED DESCRIPTION OF THE PREFERRED EMBODIMENT

Figure 1:
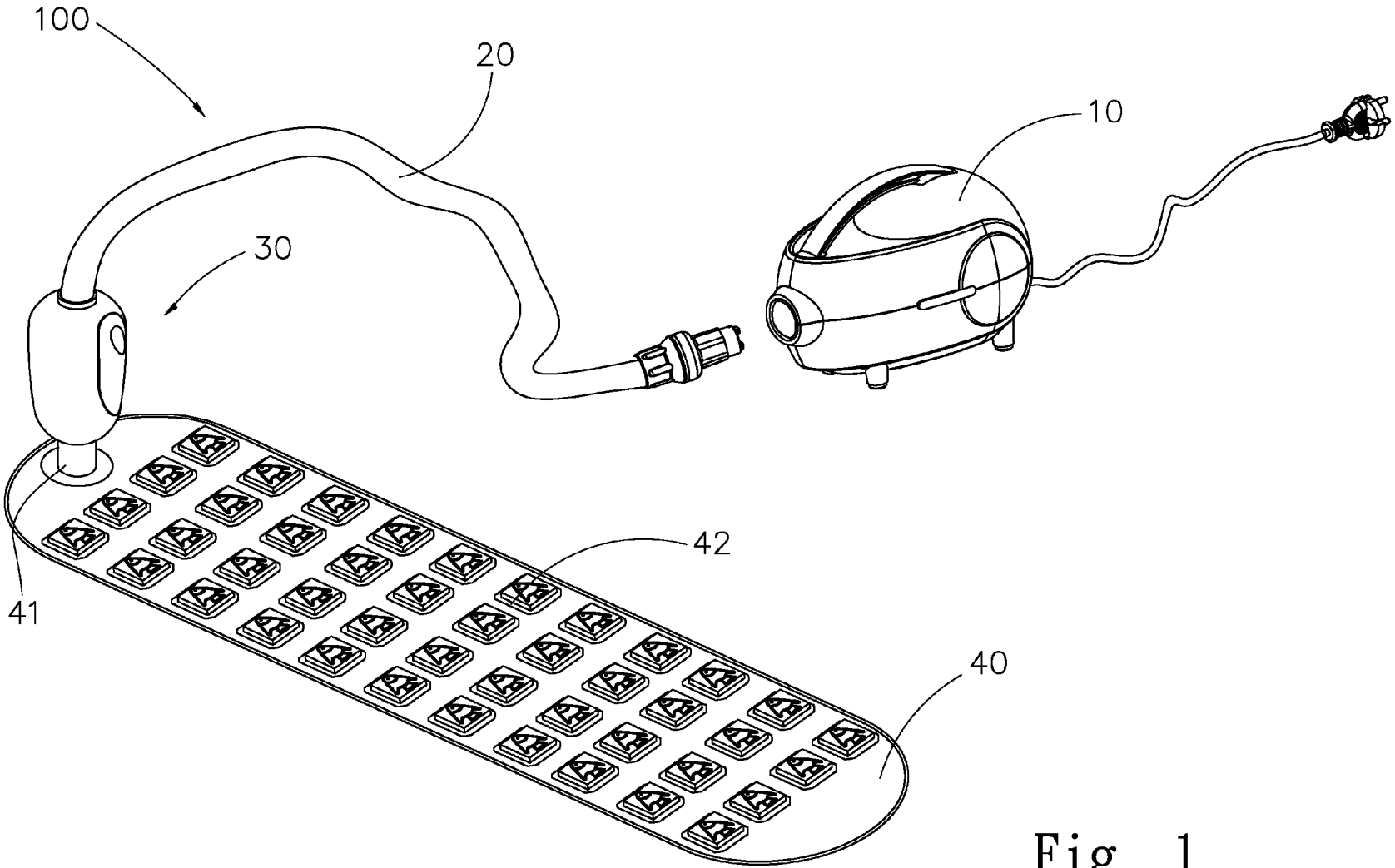
FIG. 1 illustrates a light-emitting spa bubble massager in accordance with a first embodiment of the present invention.
Figure 2:
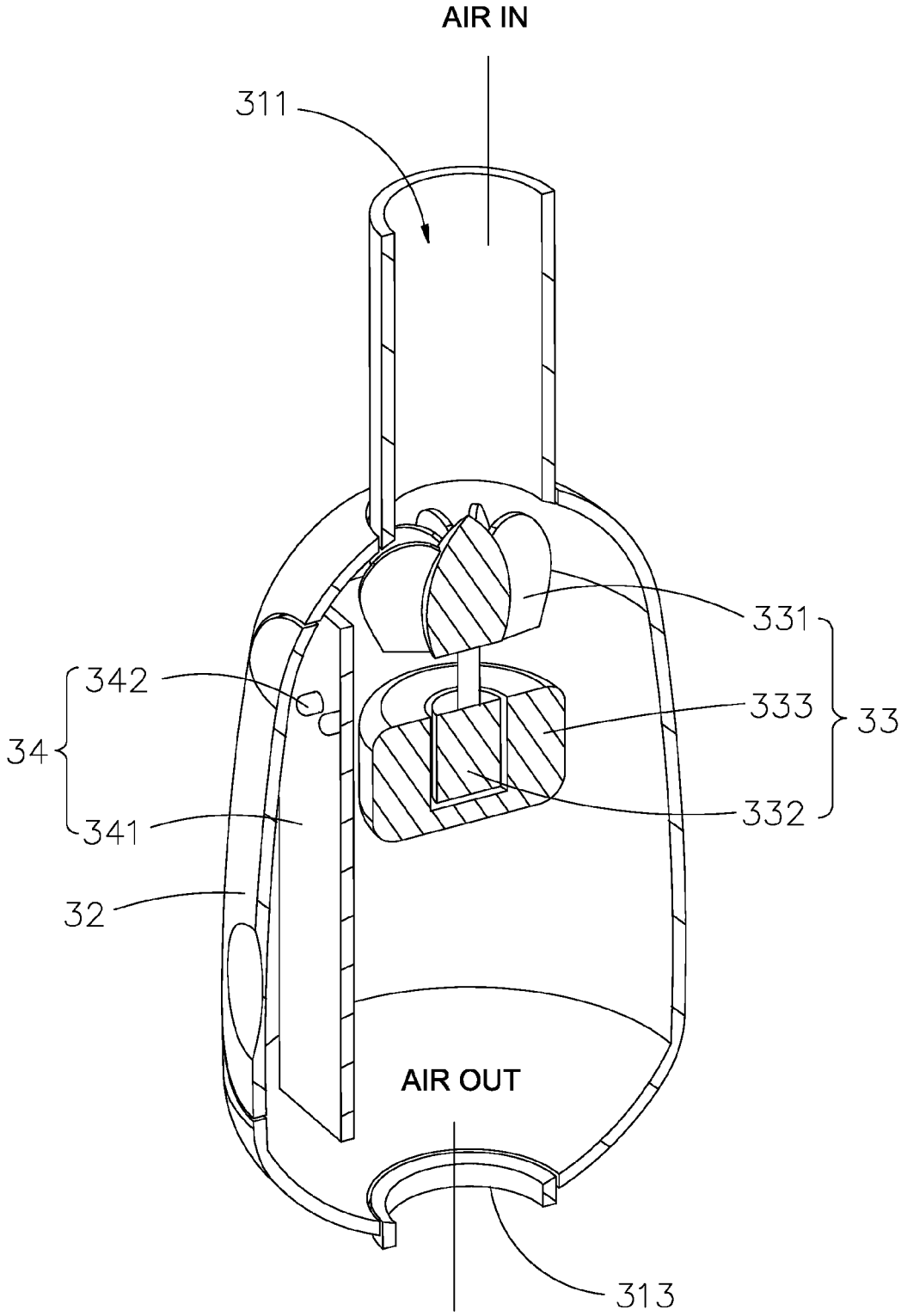
FIG. 2 is a sectional elevation, in an enlarged scale, of the air-driven light source of the light-emitting spa bubble massager in accordance with the first embodiment of the present invention.
Figure 3:
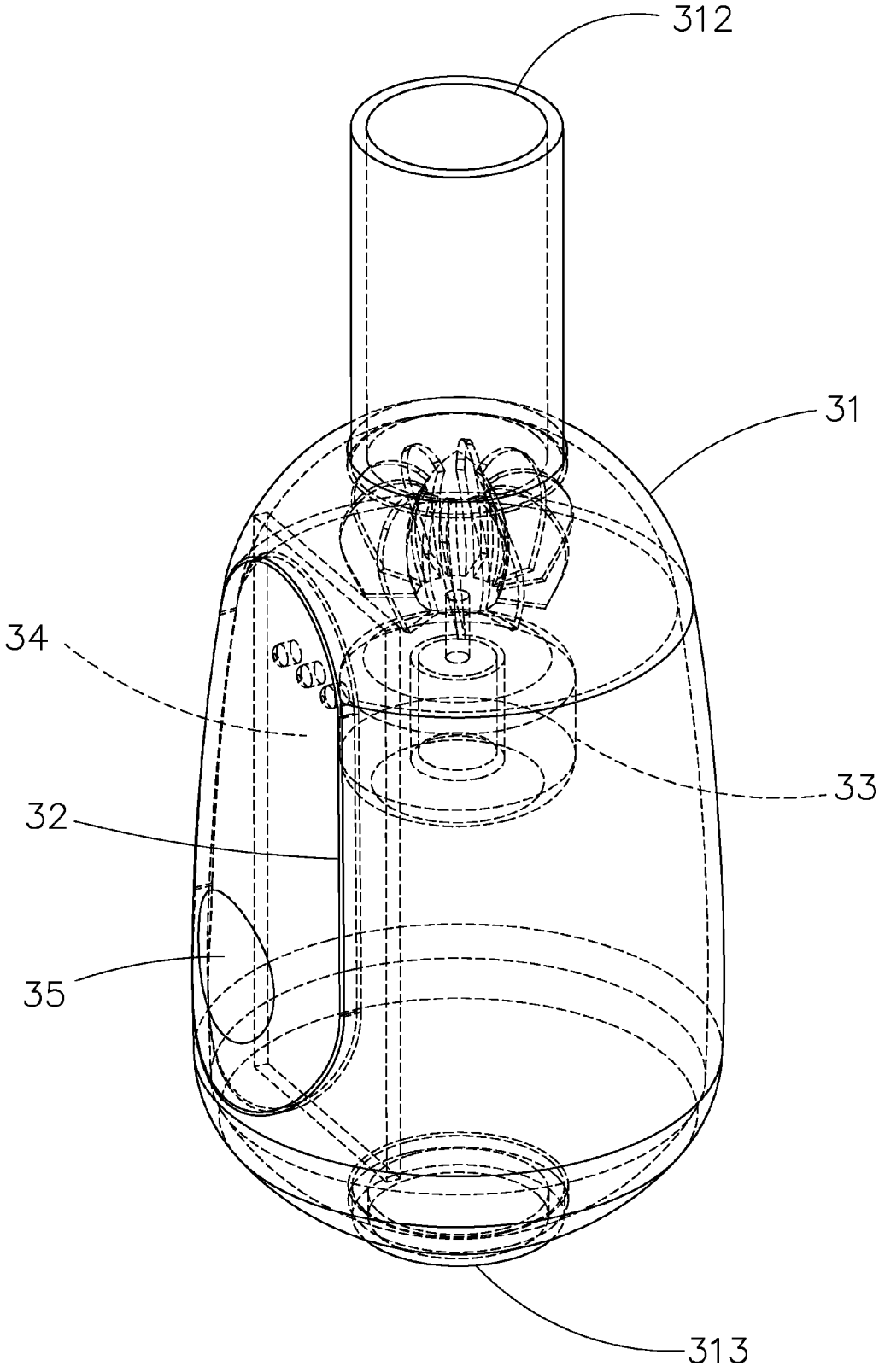
FIG. 3 is a perspective view, in an enlarged scale, of the air-driven light source of the light-emitting spa bubble massager in accordance with the first embodiment of the present invention.
Figure 4:
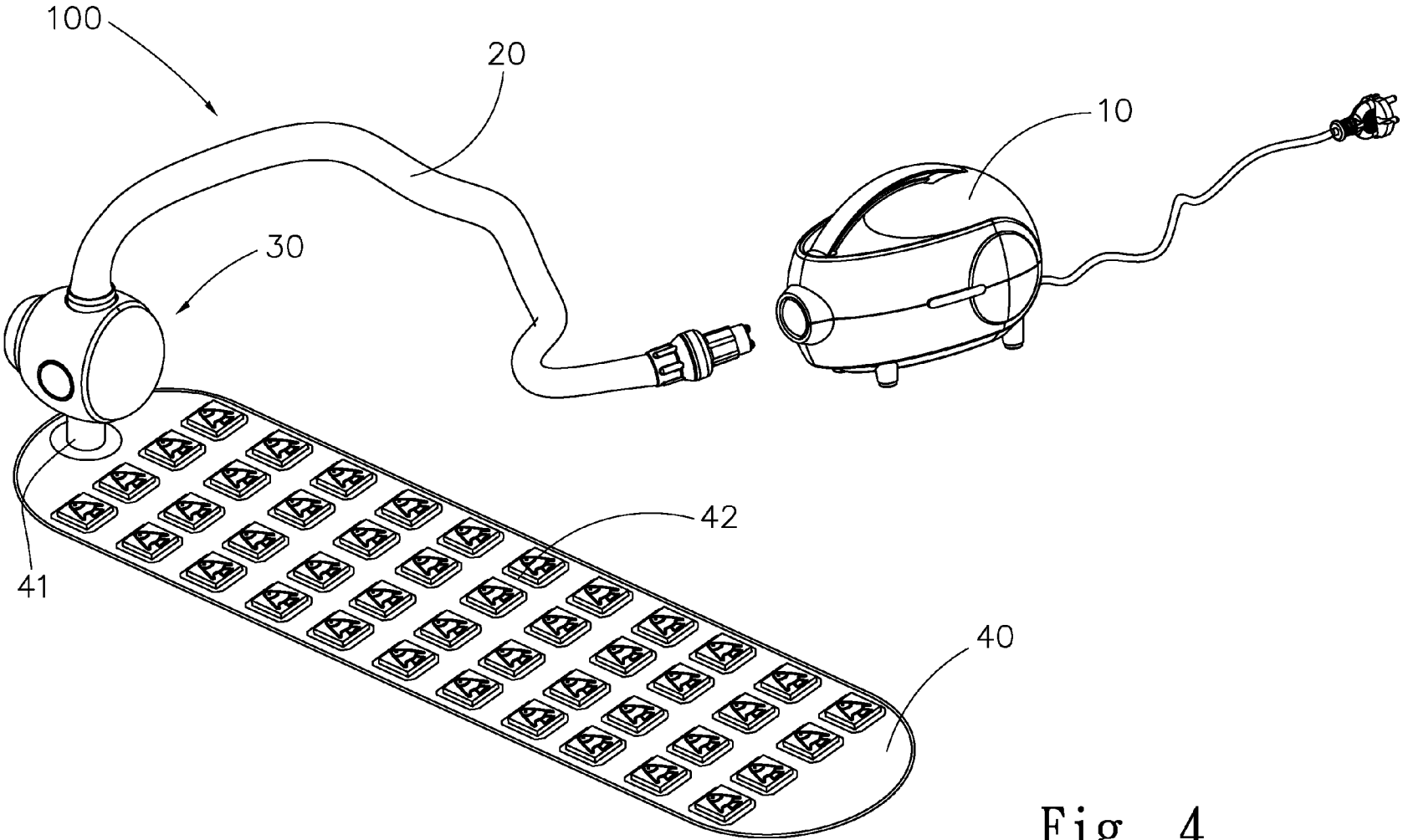
FIG. 4 illustrates a light-emitting spa bubble massager in accordance with a second embodiment of the present invention.
Figure 5:
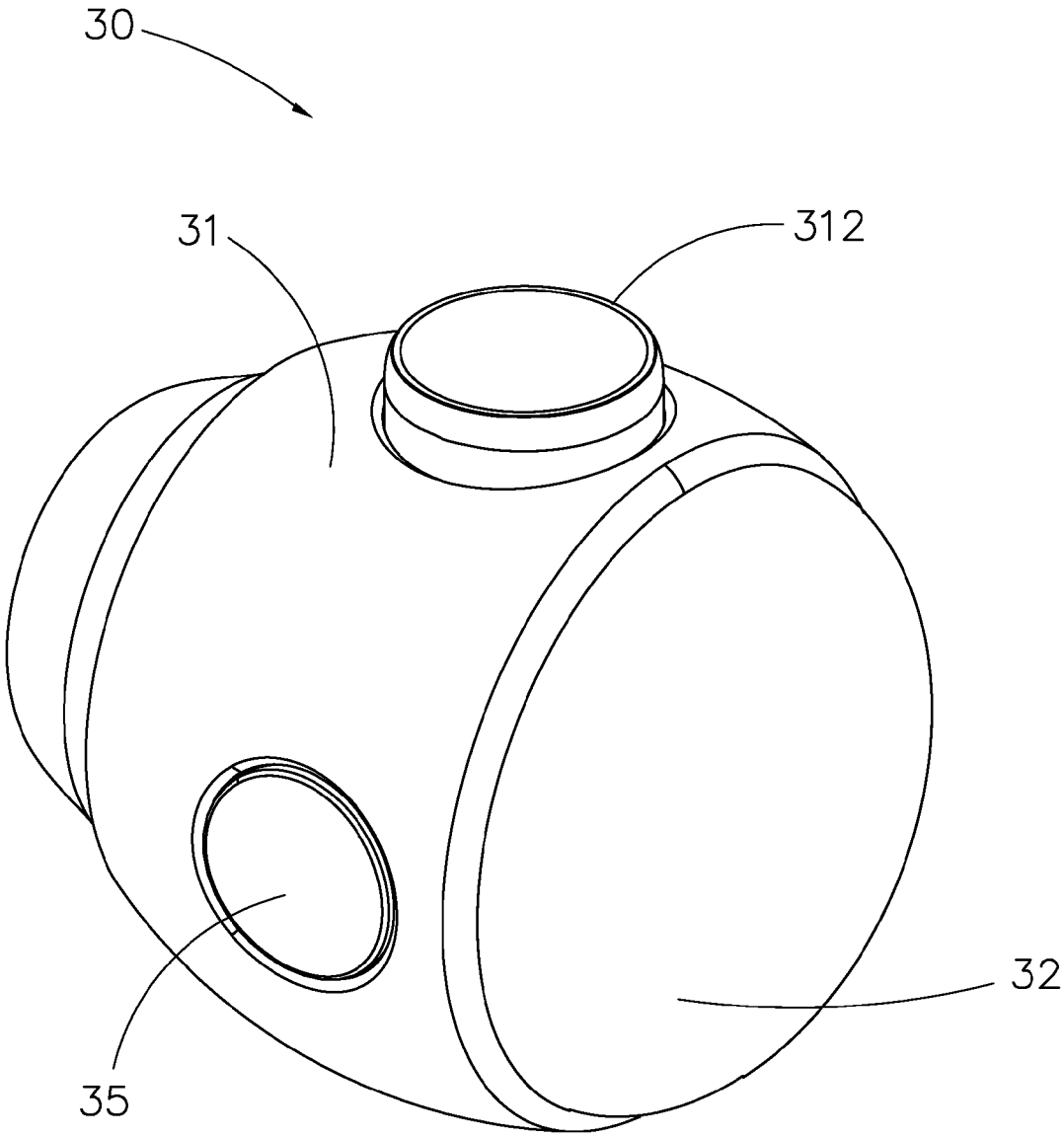
FIG. 5 is an oblique elevation, in an enlarged scale, of the air-driven light source of the light-emitting spa bubble massager in accordance with the second embodiment of the present invention.
Figure 6:
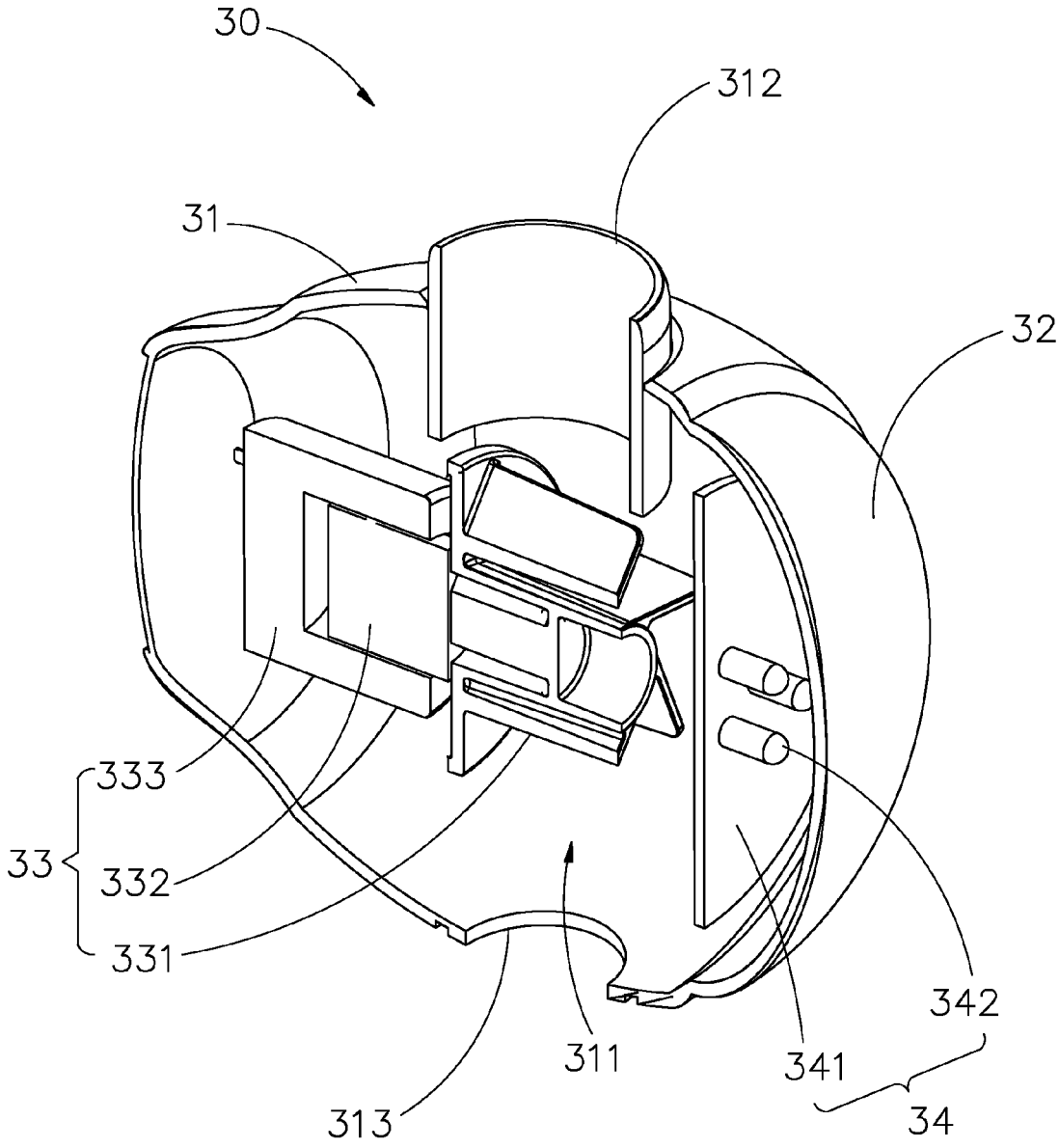
FIG. 6 is a sectional elevation, in an enlarged scale, of the air-driven light source of the light-emitting spa bubble massager in accordance with the second embodiment of the present invention.
Figure 7:
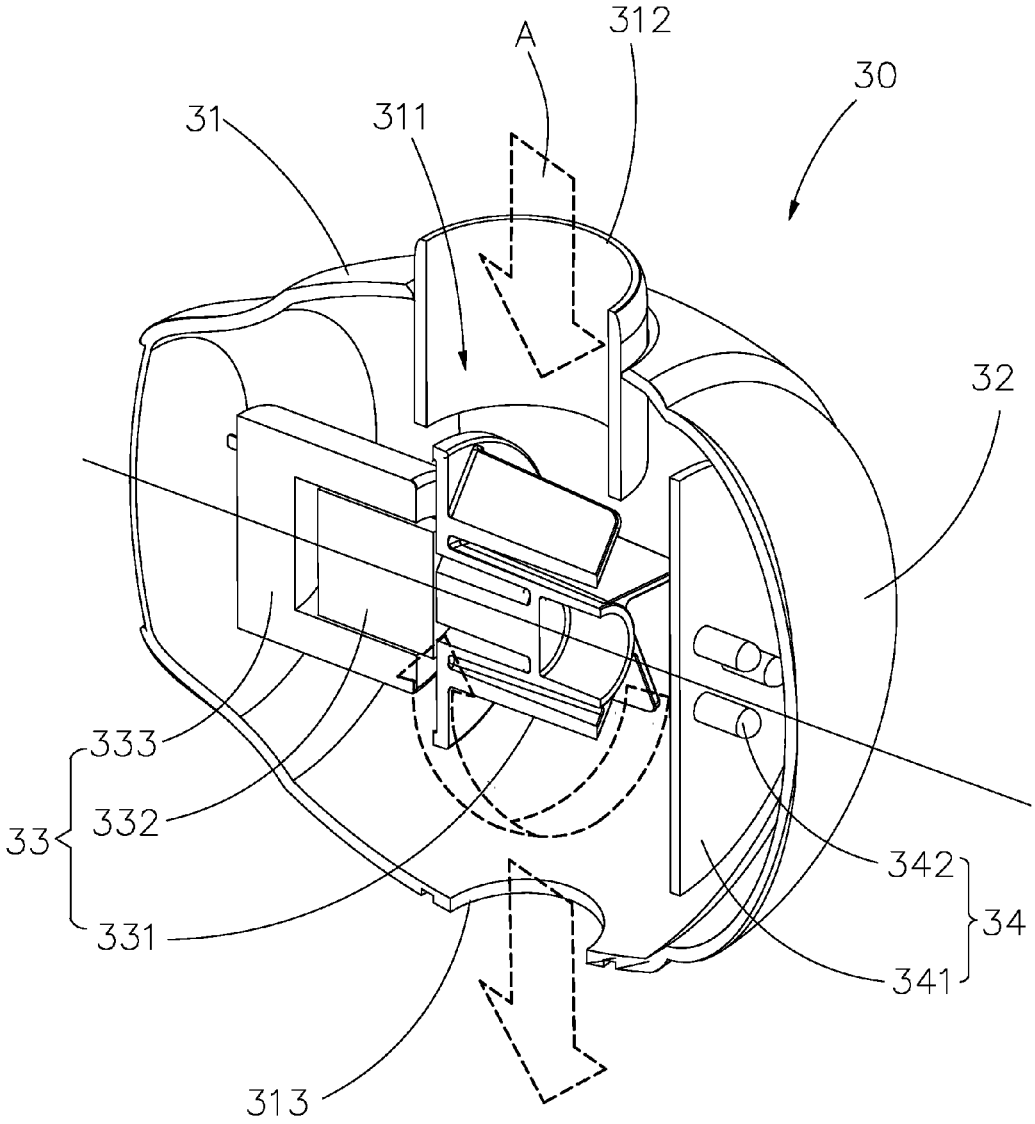
FIG. 7 corresponds to FIG. 6, illustrating the vane rotated.

Referring to FIGS. 1-3, a light-emitting spa bubble massager 100 in accordance with a first embodiment of the present invention is shown comprising an air provider 10, a connection tube 20, an air-driven light source 30 and a bubble bath mat 40.

Referring to FIG. 1 again, the air provider 10 can be an air blower, or any device that uses electricity to produce an output flow of air.

Referring to FIG. 1 again, the connection tube 20 is a flexible tube, for example, hose.

Referring to FIGS. 1-3 again, the air-driven light source 30 comprises a housing 31, a lampshade 32, an electrical generator 33 and a light-emitting module 34. The housing 31 is a waterproof shell formed of two symmetrical halves, having an air inlet 312, and air outlet 313 and an air passage 311 in communication between the air inlet 312 and the air outlet 313. The lampshade 32 is prepared from a waterproof and light-transmissive material, and mounted in one side of the housing 31. The electrical generator 33 is mounted in the air passage 311 inside the housing 31, and adapted for converting kinetic energy into electricity. The light-emitting module 34 is mounted in the housing 31 adjacent to the lampshade 32 and electrically connected to the electrical generator 33 for receiving electricity from the electrical generator 33 and emitting a predetermined color or colors of light toward the lampshade 32.

Referring to FIG. 1 again, the bubble bath mat 40 is to be set in a bathtub under the water, having an air inlet 41 for air in and multiple jet nozzles 42 for output of inputted air to produce bubbles.

Under understanding of the structural details of the light-emitting spa bubble massager 100, the operation and advantages of the light-emitting spa bubble massager 100 will be described hereinafter.

At first, connect the two distal ends of the connection tube 20 to the air provider 10 and the air inlet 312 of the housing 31 of the air-driven light source 30, and then attach the air outlet 313 of the housing 31 of the air-driven light source 30 to the air inlet 41 of the bubble bath mat 40. When in use, put the air-driven light source 30 and the bubble bath mat 40 in the water in a bathtub (or water pool). When the air provider 10 starts to output a flow of air A, the flow of air A goes through the connection tube 20 into the air inlet 312 and air passage 311 of the air-driven light source 30 to move the electrical generator 33, driving the electrical generator 33 to generate electricity for the light-emitting module 34 (see FIG. 2), and therefore the light-emitting module 34 is driven to emit light when the flow of air A is going through the air-driven light source 30. At the same time, the flow of air A keeps going out of the air-driven light source 30 into the air inlet 41 of the bubble bath mat 40 toward the multiple jet nozzles 42, When the flow of air A goes out of the jet nozzles 42 into the water in the bathtub (or water pool), producing bubbles to massage the body of the user bathing in the bathtub (or water pool). Subject to the light emitted by the light-emitting module 34, a visual effect is produced when the user enjoys a bubble-massaging bath.

As the invention utilizes the kinetic energy of the flow of air A to drive the electrical generator 33, no extra power supply is consumed for driving the light-emitting module 34 to emit light, avoiding leakage of the use of an external power source and assuring a high level of safety.

Further, the electrical generator 33 can be a magnetic type or rotor coil type electrical generator.

Further, as shown in FIG. 2, the electrical generator 33 comprises a vane wheel 331, a shaft 332 and a commutator 333. The vane 331 and the shaft 332 are coaxially fastened together, enabling the shaft 332 to be rotated with the vane wheel 331. The commutator 333 is coaxially connected to the shaft 332. According to this embodiment, the vane wheel 331 of the electrical generator 33 is arranged in a parallel manner relative to the extending direction of the air inlet 312, air passage 311 and air outlet 313 of the housing 31. Therefore, when the flow of air goes out of the air provider 10 through the connection tube 20 into the air-driven light source 30, it flows in proper order through the air inlet 312, air passage 311 and air outlet 313 of the housing 31 to rotate the vane wheel 331 and shaft 332 of the electrical generator 33, causing the commutator 333 to induce electricity for driving the light-emitting module 34.

Further, the light-emitting module 34 comprises a control circuit board 341 electrically connected to the electrical generator 33, and a plurality of color LEDs (light emitting diodes) 342 installed in the control circuit board 341 and controlled by the control circuit board 341 to emit light subject to a predetermined operation mode.

Referring to FIG. 3 again, the air-driven light source 30 further comprises a control switch 35 installed in the housing 31 and electrically connected to the light-emitting module 34 for controlling the light emitting sequence and duration of the color LEDs 342 of the light-emitting module 34.

FIGS. 4~7 illustrate a light-emitting spa bubble massager 100 in accordance with a second embodiment of the present invention. This second embodiment is substantially similar to the aforesaid first embodiment with the exception of the locations of the control switch 35 and lampshade 32 the air-driven light source 30 and the arrangement of the vane wheel 331 of the electrical generator 33. According to this second embodiment, the vane wheel 331 of the electrical generator 33 is arranged perpendicular to the extending direction of the air inlet 312, air passage 311 and air outlet 313 of the housing 31.

Thus, similar to the aforesaid first embodiment, when the flow of air goes out of the air provider 10 through the connection tube 20 into the air-driven light source 30 in accordance with the second embodiment of the present invention, the flow of air flows in proper order through the air inlet 312, air passage 311 and air outlet 313 of the housing 31 to rotate the vane wheel 331 and shaft 332 of the electrical generator 33, causing the commutator 333 to induce electricity for driving the light-emitting module 34.

Figure 8:
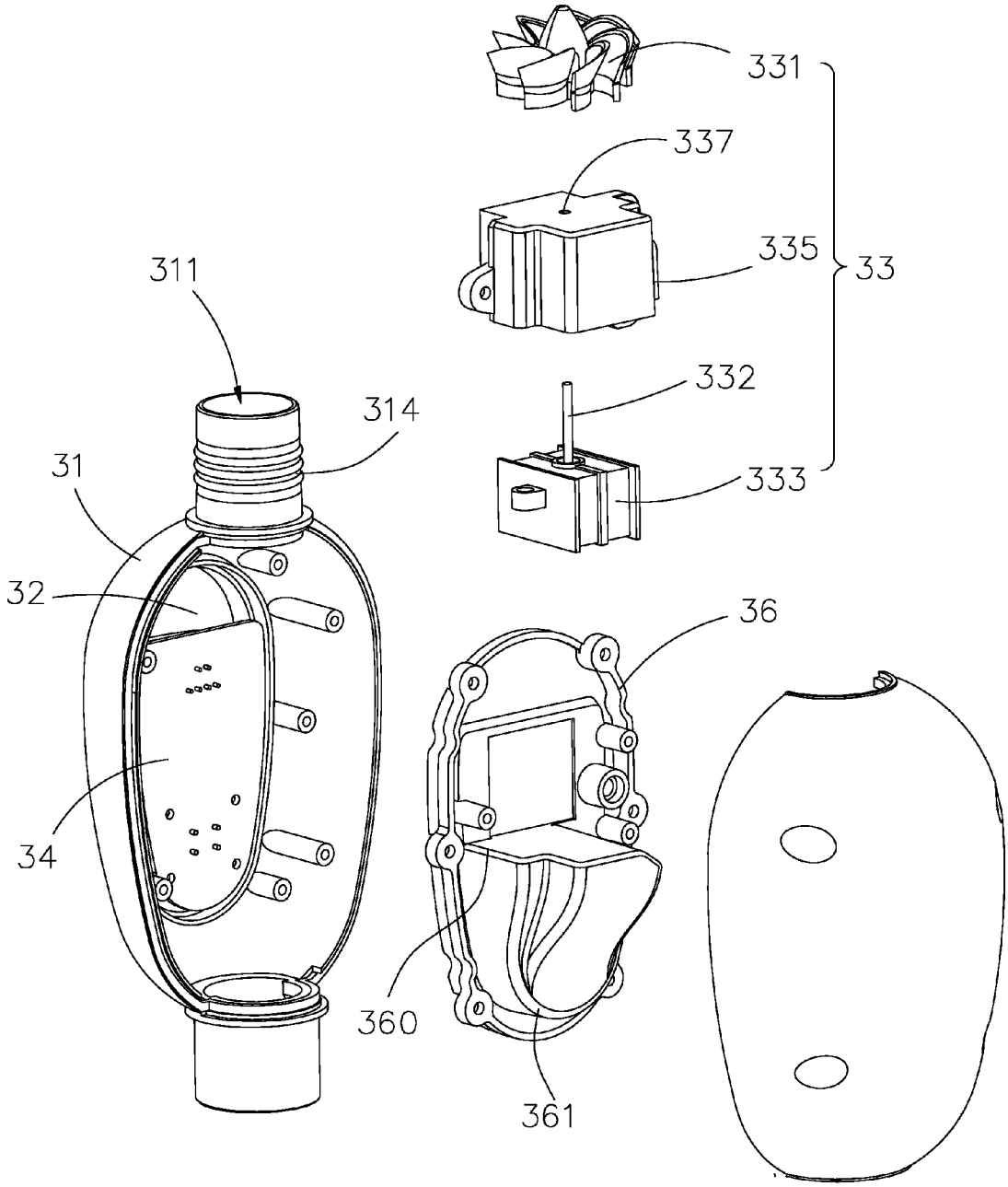
FIG. 8 is an exploded view of an air-driven light source for light-emitting spa bubble massager in accordance with a third embodiment of the present invention.
Figure 9:
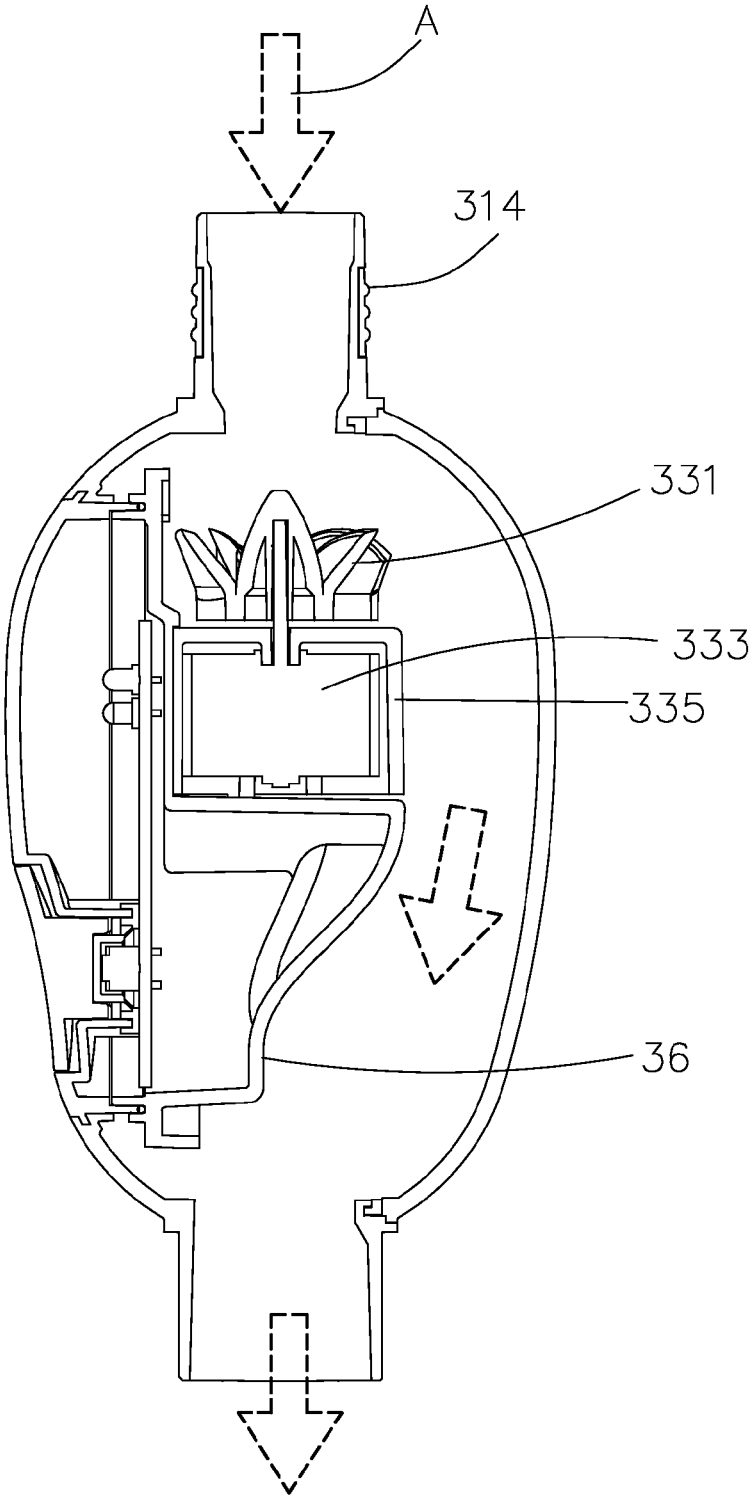
FIG. 9 is a sectional view of the air-driven light source shown in FIG. 8.

FIGS. 8 and 9 illustrate an air-driven light source for light-emitting spa bubble massager in accordance with a third embodiment of the present invention. According to this third embodiment, the air-driven light source further comprises a waterproof shield 36 and a cover 335. The waterproof shield 36 is an oval shell fitting the lampshade 32 in size. The waterproof shield 36 is mounted inside the housing 31 and affixed to the inner side of the lampshade 32 to surround the light-emitting module 34 for watertight protection. The cover 335 is affixed to the waterproof shield 36 to hold the commutator 333 of the electrical generator 33 on the inside, having an axle hole 337 for the passing of the shaft 332. The vane wheel 331 is affixed to one end of the shaft 332 outside the cover 335. Further, a waterproof stuffing material may be filled in the cover 335 around the commutator 333.

Further, the waterproof shield 36 comprises a plate member 360 perpendicularly extended from its one side for supporting the cover 335 and the commutator 333 in the cover 335, and a substantially V-shaped bottom wall 361 that has two distal ends thereof connected to the bottom side of the plate member 360.

The vane wheel 331 of the electrical generator 33 is mounted in the air passage 311 in a parallel manner relative to the extending direction of the air inlet 312, air passage 311 and air outlet 313 of the housing 31 such that when the flow of air flows through the air inlet 312, air passage 311 and air outlet 313 of the housing 31, it rotates the vane wheel 331 and shaft 332 of the electrical generator 33, causing the commutator 333 to induce electricity for driving the light-emitting module 34. Further, the V-shaped bottom wall 361 of the waterproof shield 36 facilitates smooth and rapid flowing of the flow of air through the air passage 311 of the housing 31 toward the air outlet 313.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A light-emitting spa bubble massager, comprising:

an air provider adapted for outputting a flow of air;

a connection tube having one end thereof connected to said air provider;

an air-driven light source, said air-driven light source comprising a housing, said housing having an air inlet connected to an opposite end of said connection tube for guiding in the flow of air provided by said air provider, an air outlet and an air passage in communication between said air inlet and said air outlet, a lampshade mounted in one side of said housing, an electrical generator installed in said air passage and operable by the flow of air passing through said air passage to generate electricity, and a light-emitting module mounted in said lampshade and electrically connected to said electrical generator and operable to emit light by the electricity generated by said electrical generator; and a bubble bath mat for putting in water in a water container, said bubble bath mat comprising an air inlet connected to the air outlet of said housing of said air-driven light source for guiding in the flow of air provided by said air provider and a plurality of jet nozzles for output of inputted flow of air into the water in the water container to produce bubbles.

2. The light-emitting spa bubble massager as claimed in claim 1, wherein said electrical generator comprises a vane wheel suspending in said air passage inside said housing of said air-driven light source and rotatable by the flow of air passing through said air passage, a commutator and a shaft connected between said commutator and said vane wheel for causing said commutator to generate electricity during rotation of said vane wheel by the flow of air passing through said air passage.

3. The light-emitting spa bubble massager as claimed in claim 2, wherein said vane wheel of said electrical generator is arranged in said air passage in a parallel manner relative to the extending direction of said air passage.

4. The light-emitting spa bubble massager as claimed in claim 2, wherein said vane wheel of said electrical generator is arranged in said air passage in a perpendicular manner relative to the extending direction of said air passage.

5. The light-emitting spa bubble massager as claimed in claim 1, wherein said air-driven light source further comprises a waterproof shield mounted in said lampshade inside said housing to surround said light-emitting module.

6. The light-emitting spa bubble massager as claimed in claim 5, wherein said waterproof shield comprises a plate member perpendicularly extended from one side thereof for supporting said commutator of said electrical generator.

7. The light-emitting spa bubble massager as claimed in claim 5, wherein said waterproof shield comprises a V-shaped bottom wall having two distal ends thereof connected to a bottom side of said plate member.

8. The light-emitting spa bubble massager as claimed in claim 5, wherein said air-driven light source further comprises a cover covered on a top side of said plate member to hold said commutator of said electrical generator on the inside, said cover having an axle hole for the passing of said shaft of said electrical generator.

9. The light-emitting spa bubble massager as claimed in claim 1, wherein said air-driven light source further comprises a control switch installed in said housing and electrically connected to said light-emitting module for controlling the light emitting sequence and duration of color light-emitting diodes of said light-emitting module.

10. The light-emitting spa bubble massager as claimed in claim 1, wherein said light-emitting module comprises a control circuit board electrically connected to said electrical generator and a plurality of light-emitting diodes installed in said control circuit board and controlled to emit light by said control circuit board subject to a predetermined operation mode.

* * * * *

UNITED STATES PATENT AND TRADEMARK OFFICE

CERTIFICATE OF CORRECTION

PATENT NO. : 8,239,980 B2
APPLICATION NO. : 12/877260
DATED : August 14, 2012
INVENTOR(S) : Tsai Ying Wu It is certified that error appears in the above-identified patent and that said Letters Patent is hereby corrected as shown below:

On the title page, item [75]

the "Inventor: Tsai Ying, Zhonghe (TW)" should read
--Inventor: Tsai Ying WU, Zhonghe (TW)--

Signed and Sealed this
Thirtieth Day of April, 2013

Teresa Stanek Rea
*Acting Director of the United States Patent and Trademark Office*